United States Patent [19]

Strangfeld

[11] Patent Number: 4,813,085

[45] Date of Patent: Mar. 21, 1989

[54] LAVATORY FLUSHING DEVICE

[75] Inventor: Reiner Strangfeld, Bückeburg, Fed. Rep. of Germany

[73] Assignee: Georg Rost & Soehne, Armaturenfabrik GmbH & Co. KG., Lerbeck, Fed. Rep. of Germany

[21] Appl. No.: 117,153

[22] Filed: Nov. 2, 1987

Related U.S. Application Data

[63] Continuation of Ser. No. 847,153, Mar. 31, 1986, abandoned.

[30] Foreign Application Priority Data

Apr. 4, 1985 [DE] Fed. Rep. of Germany ..... 3512305225

[51] Int. Cl.[4] ..... E03D 1/22

[52] U.S. Cl. ..... 4/363

[58] Field of Search ..... 4/363, 364, 366

[56] References Cited

U.S. PATENT DOCUMENTS

| | | | |
|---|---|---|---|
| 2,114,820 | 4/1938 | Smith | 4/364 |
| 2,685,301 | 8/1954 | Dreier | 137/403 X |
| 2,727,527 | 12/1955 | Horvath | 137/403 |
| 2,806,483 | 9/1957 | MacCauley et al. | 137/403 |
| 3,392,407 | 7/1968 | Booth | 4/363 X |
| 3,543,309 | 12/1970 | Boone | 4/363 X |
| 4,358,864 | 11/1982 | Medrano | 4/363 X |
| 4,462,124 | 7/1984 | Antos et al. | 4/364 X |

FOREIGN PATENT DOCUMENTS

| | | | |
|---|---|---|---|
| 404844 | 1/1934 | United Kingdom | 4/363 |

*Primary Examiner*—Charles E. Phillips
*Attorney, Agent, or Firm*—Laubscher & Laubscher

[57] ABSTRACT

A lavatory flushing device includes a lavatory basin provided with a flushing box having a filling valve and a discharge valve. A separating wall separates the flushing box into a flushing chamber containing the discharge valve, and a further chamber containing the filling valve. At least one water conduit leads from the filling valve into the flushing chamber. The separating wall is provided with an overflow conduit, which is directed to a rerouting device so as to close the filling valve following termination of the flushing process. Thus a very high water level is obtainable in the flushing chamber so as to achieve an effective lavatory flushing even at relatively low flow pressures in the supply conduit, and also if, due to esthetic reasons, the flushing box exceeds the level of the lavatory basin by only a small amount.

12 Claims, 2 Drawing Sheets

LAVATORY FLUSHING DEVICE

This is a continuation of application Ser. No. 06/847,153, filed 03/31/86.

BACKGROUND OF THE INVENTION

The present invention relates to a lavatory flushing device including a lavatory basin, and a flushing box with a filling valve and a discharge valve. For reasons of esthetics, particularly in the case of one-piece lavatories, the flushing box behind the lavatory basin and attached thereto is constructed so as to have a low profile and therefore exceeds the upper edge of the basin by only a relatively small amount. Taking into account the required safey distances of the water line to an overflow line, as well as taking into account other safety distances, which are due to the filling valve and its construction, as well as the safety distance to the lower edge of the flushing box, there results in such types of lavatory flushing devices a relatively low water line or level in the filled flushing box, which in turn results in a relatively weak flushing stream; such a weak flushing stream makes it difficult to satisfactorily initiate the required suction process towards the end of the flushing process. Also generation of a satisfactory rim flushing is problematic, as filling of the rim flushing channel directly from the flushing box can only be obtained with difficulty. For this reason in the case of one-piece flushing lavatories an appropriate conduit leading from the discharge valve in the flushing box to the rim flushing channel is usually dispensed with.

Hence the rim flushing channel must be fed by the through-flow of the filling valve. It is for this reason that flushing lavatories of the aforedescribed type require a relatively high minimum flow pressure in the supply conduit, resulting, in turn, in other use limitations.

Even in the case of high flow pressures it is a disadvantage, that the comparatively slow initiation of the suction process brings about a considerable consumption of water. It is also a problem that any sealing imperfections in the discharge valve result in water flow in the basin, as in lavatories of this type the flushing channel normally lies below the water level of the odor closure. As, on the other hand, the water level in the flushing box is always maintained by the filling valve on the water-line level, a high degree of water loss may result.

SUMMARY OF THE INVENTION

It is therefore an object of the present invention to devise a lavatory flushing system of the aforedescribed kind, which ensures proper flushing even in the case of relatively low flow pressures prevailing in the supply conduit.

This object is achieved by a separating wall separating the flushing box into a flushing chamber containing the discharge valve, and a further chamber containing the filling valve, and by the provision of at least one water conduit leading from the filling valve into the flushing chamber.

By creating a flushing chamber containing the discharge valve, but which does not contain any filling valve, this flushing chamber can be brought to the highest possible waterline level, as only a safety distance with respect to the upper edge of the flushing box need be taken into account. Consequently a strong flushing stream can be created upon triggering of the flushing process as a result of the high water-line level, inspite of a relatively low-lying flushing box. By advantageously actuating the filling valve simultaneously with the actuation of the discharge valve, in a preferred embodiment, the filling valve can then supplement supply of the rim flushing channel by employing part of the through-flow, while another part of the through-flow serves for the supply of the flushing chamber. Consequently the flushing stream is well supported by the rim flow.

Taking into account the fact that the filling valve is no longer disposed in the water contained in the flushing box and provided for the flushing stream, it is nevertheless advisable to achieve a valve closure control which is as simple as possible. In accordance with an extremely advantageous further embodiment of the invention, overflow means are associated with the separating wall, and rerouting means associated with the filling valve are disposed in the further chamber, and wherein the overflow means are directed towards the rerouting means. Consequently, if the flushing chamber should overflow towards the end of the flushing process over the separating wall due to the continuous supply of water to the flushing chamber through the open flushing valve, the overflowing water resulting therefrom passes to the rerouting means associated with the filling valve, and closes the filling valve.

The discharge valve disposed in a floor region of the flushing chamber has associated therewith a water conduit leading to the lavatory basin, as well as a water conduit leading to the rim flushing channel. In a particularly advantageous embodiment the discharge valve is constructed so that it opens in an initial opening phase thereof only the water conduit leading to the rim flushing channel, but opens in the final opening phase thereof also the conduit leading to the lavatory basin. The flushing stream starting at the commencement of the opening is therefore primarily guided to the the rim flushing channel, from which extremely high requirements are demanded in part as regards the quality of flushing. It is well to recall that in this phase the relatively high water level of the flushing chamber is still available. Only upon a complete opening of the discharge valve does water flow also into the lavatory basin through a conduit communicating therewith, and starts initiation of a whirling action of the water volume present in the basin. In conjunction with the water for the rim flushing channel the required quantity of water is also made available quickly to initiate filling of the suction portion of the odor closure, so as to commence the suction process. Initiation of the suction process is accomplished comparatively quickly, and consequently at a low consumption of water.

It is to be further pointed out that in view of the inventive arrangement any imperfect sealing in the discharge valve is per force noticed, for in such an eventuality the water level in the flushing chamber ebbs, without there occuring any resupply of water through the filling valve. As a result of the water losses flushing worsens progressively, so that such sealing imperfections are per force noticed, and can consequently be remedied.

Further advantages of the invention will in part become obvious from the description of the specific embodiments which follow, and the claims following the description of the specific embodiments.

BRIEF DESCRIPTION OF THE DRAWING

FIG. of the drawing shows a cross-section of the flushing system of the aforedescribed type, and wherein for clarity's sake the flushing box has been illustrated in a position pivoted by 90° with respect to the flushing basin

DESCRIPTION OF THE PREFERRED EMBODIMENT

Figure 1:
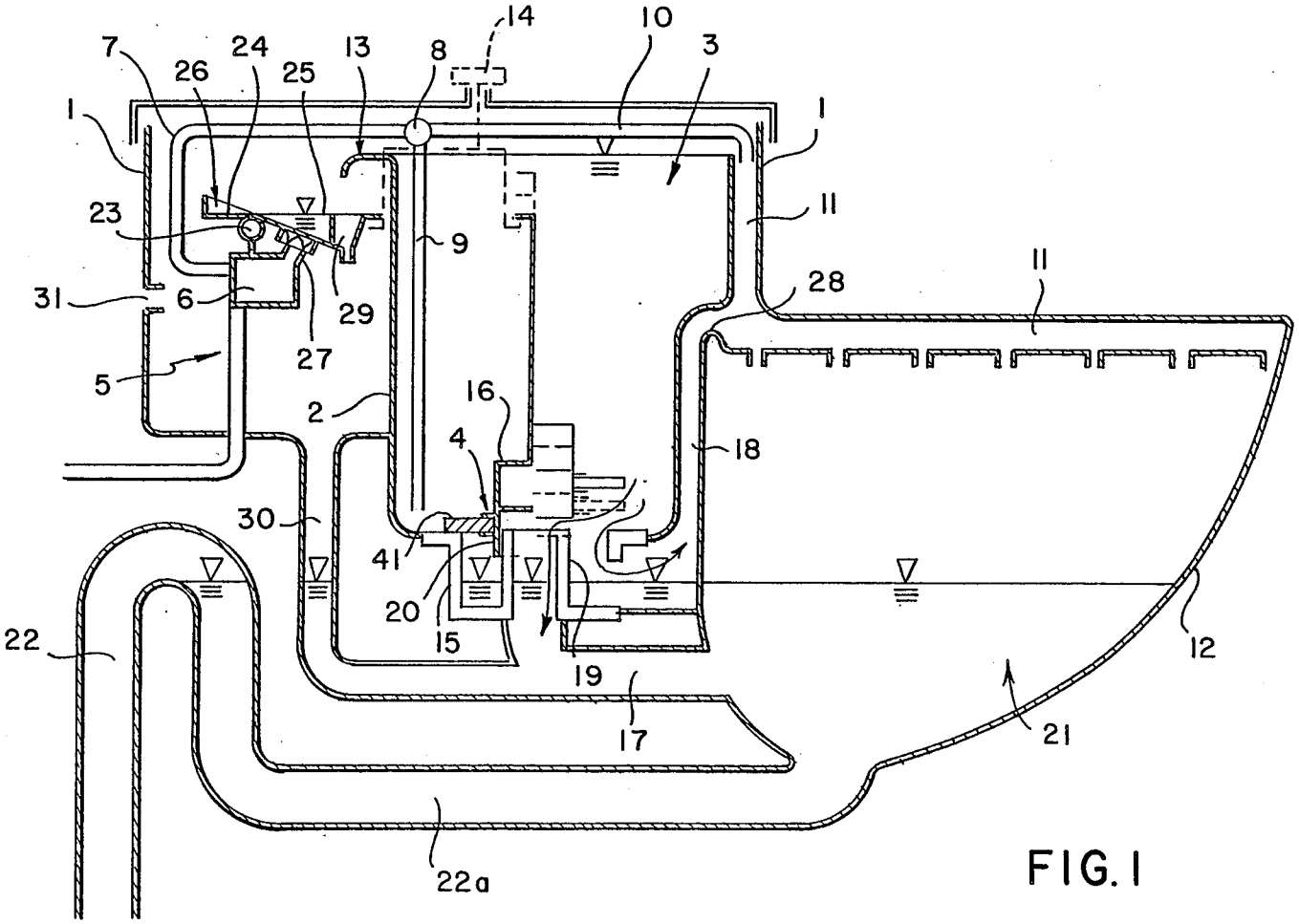

Referring now to the drawing, a flushing box 1 is subdivided by a separating wall 2 into a flushing chamber 3, which contains a discharge valve 4 in a floor region thereof, as well as into an additional chamber 5, in which there is disposed a flushing or filling valve 6. The flushing or filling valve 6 can supply the flushing chamber 3 from the chamber 5 through a water supply conduit, as well as supply advantageously a rim flushing channel 11, through a branch 8. For this purpose there is at first provided, starting from the filling valve 6, a water conduit 7 above and beyond the separating wall 2, leading to a branch 8, from which, in turn, one conduit 9 leads to the flushing chamber 3, while a further conduit 10 leads to the rim flushing channel 11 of the water basin 12, which in the example illustrated is joined in one piece with the flushing box 1.

An overflow conduit 13 leading from an upper region of the flushing box 1 to the chamber 5 is associated with the separating wall 2. The overflow conduit 13 is directed towards a rerouting device associated with the filling valve 6, which feature will be described in further detail in what follows.

Due to the separating wall 2, the flushing chamber 3 can be brought to a maximal or highest possible steady-state water level explained in further detail hereinafter, and it is only necessary to maintain a safety distance with respect to the upper edge of the flushing box 1 of about 10–15 mm, so that in an extreme case the flushing chamber 3 may not overflow on an exterior side of the flushing box 1.

In the example shown, which shows the water closet or lavatory device in an operative state, flushing is initiated by pulling of the actuation knob 14. The discharge valve 4 then lifts a sealing element 41 from a seating piece 15 of synthetic material disposed in the floor of the chamber 3 from that floor, and then remains in an open position up to the termination of the flushing process, being held up by holding means which are illustrated only schematically, and being implemented, for example, by a float 16. Within the region of the discharge valve 4 there is disposed centrally a main flushing channel 17 leading downwardly to the flushing basin 12, as well as a stream channel 18 in a lateral region of the discharge valve 4, which leads to the rim flushing channel 11. The discharge valve 4 is preferably so formed that it opens substantially the stream channel 18 leading to the rim flushing channel 11 in a first phase of its opening path, while water can also enter the main flushing channel 17 only upon the discharge valve 4 being completely opened. In the embodiment shown the seating piece 15 of synthetic material is provided with a central member 19 forming a passage to the main flushing channel 17, on which there is displaceably guided a central sleeve 20 of the discharge valve 4. As shown in the drawing, the device operates in such a manner that following lifting of the sealing element 41 of the discharge valve 4 from the seat of the seating piece 15, at first only the water of the flushing chamber 3 leading to the stream channel 18 is released, followed by release of the water to the rim flushing channel 11; this results in an extraordinarily strong rim flushing effect, as initially the high water level of the flushing chamber 3 is fully available. In this phase, the passage of member 19 is not yet opened by the sleeve 20, as illustrated in the drawing.

Figure 2:
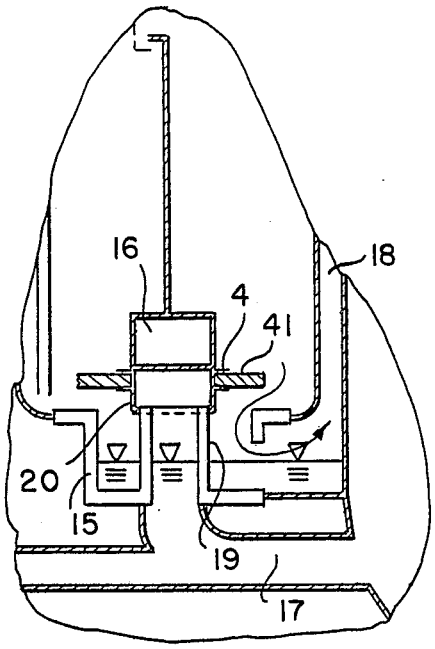
FIGS. 2 and 3 show a discharge valve of the flushing system in various degrees of opening.
Figure 3:
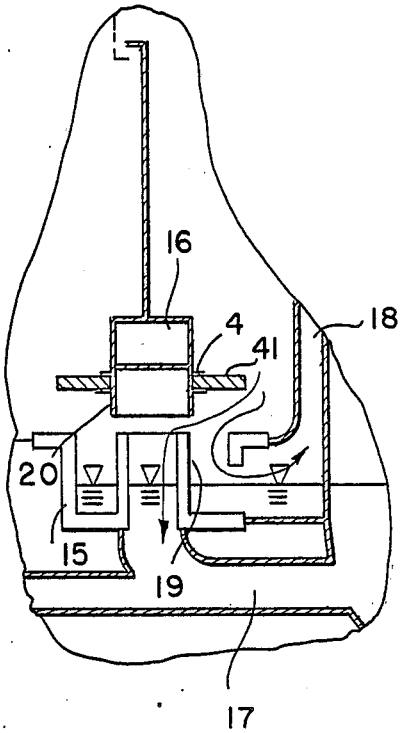

Here, as the sealing element 41 has been lifted from the seat of the seating piece 15, in this first opening phase the flushing water passes from the flushing chamber 3 in the direction of the arrow A into the stream channel 18, so as to lead to a strong rim flushing of the basin 12. As shown in FIG. 2, the centrally located sleeve 20 associated with the discharge valve 4 remains still closed, as it still closes the upper end of the member 19 in this opening phase of the flushing process, so that the main flushing channel also remains closed. In FIG. 3 the sleeve 20 is shown lifted from the seating piece 15, so that water flows in full force into the main channel 17 through the member 19, as shown in the direction of the arrow B. The force of the rim flushing is correspondingly reduced in this second flushing phase.

Only upon full opening of the discharge valve, as shown in FIG. 3 of the drawing 4 does water therefore also enter into the main channel 17, ensuring not only the commencement of a whirling action of the water volume 21 present in the water basin 12, but also an adequate water supply in conjunction with water for the rim flushing, so as to initiate the water being suctioned off by filling the suctioning branch 22 of the odor closure **22*a***.

The fact that the seating piece 15 is of synthetic material, and can therefore be manufactured with close manufacturing tolerances, contrary to ceramic elements, also contributes to an optimal distribution of the flushing water between the rim flushing channel 11, and the main flushing channel 17.

The filling valve 6 is also opened together with the actuation of the discharge valve 4 by means of the actuating knob 14. The through-flow which consequently starts immediately thereafter passes through the conduit 7 to the water branch 8. A part of the through-flow then flows through the conduit 10 to the rim flushing channel 11 and supports a rapid filling of the lavatory, while the other part of the water passes through the conduit 9 into the flushing chamber 3.

A special rerouting device is associated with the filling valve 6, which, on one hand, permits a simple maintenance of the open position, and on the other hand, allows a very simple closure of the filling valve 6 towards the end of the flushing process.

In the example illustrated for this purpose a control lever arm 24 pivotable about a bearing 23 is associated with the filling valve 6, which lever arm 24 defines on its right end a first and relatively large chamber 25, and on its left end a chamber 26 smaller than the chamber 25. The control lever arm 24 is pivoted by means of the actuating knob 14 in a counter-clockwise direction, as a result of which both the servo-bore 27, as well as the non-illustrated main valve of the filling valve 6 are opened. Any water still remaining from the last closure process in the right chamber 25 flows, as result of the pivoting movement of the control lever arm 24, into the left chamber 26, and consequently maintains the control lever arm 24 in its pivoted open position even during a reverse actuating movement.

The overflow conduit 13 of the separating wall 2 is now directed towards the aforedescribed rerouting device of the filling valve 6, namely here towards the chamber 25. Following termination of the flushing process, the flushing chamber 3, and as a result of the suctioning off of the water, also the odor closure of the lavatory basin are emptied. Both volumes are again replenished by the filling valve 6 through the branch 8. This may, for example, be accomplished by manual adjustment of the effected regions of the flushing system, when initially setting up or operating the system, so that the aforesaid volumes may be replenished approximately simultaneously. Here it has been shown advantageous to continue full employment of the water, which continues to flow through the conduit 10 for replenishment of the odor closure, and also for rim flushing of a relatively long duration.

For this purpose the rim flushing channel 11 is formed with an embossment 28, which prevents back flow of this water into the stream channel 18.

If, following filling of the flushing chamber 3, when the filling valve 6 is open, the water spills over through the overflow conduit 13, then the right and larger chamber 25 of the control lever arm is filled by this water. In this manner the weight of the water urging rotation of the left chamber 26 in a counter-clockwise sense is overcome. The control lever arm 24 is then pivoted back in a clock-wise sense, and wherein the water from the left chamber 26 still overflows into the right chamber 25. The right chamber 25 has a considerably larger volume, namely of such a magnitude that it suffices for a sufficient sealing of the servo-bore 27 of the filling valve 6. In addition to the aforesaid closed chamber 25, there is advantageously provided an additional smaller chamber 29 with a discharge opening, which supports pivoting of the control lever arm 24 in a clock-wise sense, and which is emptied following closure of the filling valve 6.

Any excess water run-off, which naturally is exhausted only slowly, or in a delayed manner, is routed away into the lavatory basin in its entirety through a stream channel 30 formed in the floor of the chamber 5. Advantageously an upright leg of the stream channel 30 is made relatively long, i.e. the floor of the chamber 5 is therefore elevated to a relatively high level. This ensures that during the flushing process not too much water volume passes into the chamber 5, which could otherwise weaken the flushing action.

For this reason it is also advantageous to provide for the cross-sectional area of the stream channel 30 to be only as large as to ensure that in the case of a defective filling valve 6 the maximally expected through-flow at a large pressure is safely routed away, without the through-flow exiting through an opening 31 provided on a lateral wall of the chamber 5. The opening 31 is provided slightly above the upper edge of the lavatory basin 12, and therefore defines the maximal possible water level in the chamber 5 containing the filling valve 6. Consequently in this chamber 5 an overflow line of such a low level is created, that an arrangement of the filling valve 6 secure from any back suction is possible in a trouble-free manner.

While the invention has been illustrated in preferred embodiments, it is not to be limited to the structures shown, since many variations thereof will be evident to one skilled in the art, and are intended to be encompassed in the present invention as set forth in the appended claims.

I claim:

1. A lavatory flushing device comprising in combination a lavatory basin provided with a flushing box having a filling valve and a discharge valve, a separating wall separating said flushing box into a flushing chamber containing said discharge valve, and a further chamber containing said fillinn valve, a stream channel free of any valve means leading from said further chamber to said lavatory basin, overflow means leading from an upper region of said flushing box into said further chamber, and at least one water conduit leading from said filling valve into said flushing chamber.

2. The lavatory flushing device according to claim 1, further comprising a rim flushing channel, and a further conduit leading to said rim flushing channel through a branch, said branch communicating with said water conduit.

3. The lavatory flushing device according to claim 1, wherein said overflow means is associated with said separating wall, and further including rerouting means disposed in said further chamber for closing said filling valve or maintaining it in an open position, said overflow means being directed towards said rerouting means, whereby, upon occurrance of an overflow, water passing from said overflow means to said rerouting means causes said rerouting means to close said filling valve.

4. The lavatory flushing device according to claim 3, wherein said further chamber has a floor region, said stream channel leading from the floor region to said lavotory basin.

5. The lavatory flushing device according to claim 4, wherein said stream channel has an elongated upright portion, and wherein said further chamber is situated at a level higher than that of said lavatory basin.

6. The lavatory flushing device according to claim 4, wherein said stream channel has a cross-sectional area such that in the event said filling valve is defective, a maximally expected through-flow is still reroutable through said stream channel.

7. The lavatory flushing device according to claim 6, wherein said further chamber has at least one lateral wall formed with an opening disposed slightly above the level of an upper edge of said lavatory basin, and wherein said maximally expected through-flow is reroutable through said stream channel without having to spill over through said opening in said lateral wall.

8. The lavatory flushing device according to claim 3, wherein said rerouting means include a pivotable control lever, a first water-receiving chamber being located at one end of said control lever, a second water-receiving chamber being located at the other end of said control lever, and having a volume exceeding that of said first water-receiving chamber, said second water-receiving chamber being located below said overflow means.

9. The lavatory flushing device according to claim 3, wherein a highest possible water level is defined in said flushing box, and wherein said rerouting means is operable upon occurance of said overflow beyond said highest possible water level.

10. The lavatory flushing device according to claim 1, further including a main conduit leading to said lavatory basin, and a rim flushing channel, a stream conduit leading from said flushing chamber to said rim flushing channel, said flushing chamber being formed with a floor, said discharge valve being located on said floor and being arranged to initially open only said stream conduit leading to said rim flushing channel, and to only open said main conduit upon said discharge valve being fully opened.

11. The lavatory flushing device according to claim 10, further comprising a seating piece of synthetic material associated with said discharge valve, and having in a center region thereof a member leading to said main conduit, a sleeve of said discharge valve being slidably arranged on said member.

12. The lavatory flushing device according to claim 10, wherein said rim flushing channel is formed with an inward projection tending to prevent any water backflow into said stream conduit.

* * * * *

UNITED STATES PATENT AND TRADEMARK OFFICE

CERTIFICATE OF CORRECTION

PATENT NO. : 4,813,085

DATED : March 21, 1989

INVENTOR(S) : Reiner STRANGFELD

It is certified that error appears in the above-identified patent and that said Letters Patent is hereby corrected as shown below:

On the title page assignee should read

--Assignee: George Rost & Soehne,
Armaturenfabrik GmbH & Co. KG.,
Porta Westfalica-Lerbeck
West Germany--.

Signed and Sealed this

Thirteenth Day of February, 1990

*Attest:*

JEFFREY M. SAMUELS

*Attesting Officer*

*Acting Commissioner of Patents and Trademarks*